US008317055B2

(12) United States Patent
Zawrotny et al.

(10) Patent No.: US 8,317,055 B2
(45) Date of Patent: Nov. 27, 2012

(54) TRASH RECEPTACLE WITH TRASH BAG DISPENSER SYSTEM

(76) Inventors: Leanne Zawrotny, Mt. Laurel, NJ (US); Doreen Fries, Marlton, NJ (US)

( * ) Notice: Subject to any disclaimer, the term of this patent is extended or adjusted under 35 U.S.C. 154(b) by 0 days.

(21) Appl. No.: 13/066,508

(22) Filed: Apr. 16, 2011

(65) Prior Publication Data

US 2012/0261423 A1 Oct. 18, 2012

(51) Int. Cl.
*B65D 25/14* (2006.01)
*B65D 35/14* (2006.01)
*B65D 90/00* (2006.01)

(52) U.S. Cl. ..... 220/495.07; 220/495.11; 220/908; 220/908.1; 220/495.01; 220/495.06; 206/389

(58) Field of Classification Search ..... 220/495.07, 220/495.11, 908, 908.1, 495.01, 495.06; 206/389
See application file for complete search history.

(56) References Cited

U.S. PATENT DOCUMENTS 3,800,503 A * 4/1974 Maki ..... 53/390
4,798,363 A * 1/1989 Cortesi ..... 248/97
4,955,505 A * 9/1990 Battaglia ..... 220/495.07
5,322,179 A * 6/1994 Ting ..... 220/495.07
5,503,292 A * 4/1996 Cuccharia ..... 220/495.07
5,704,511 A * 1/1998 Kellams ..... 220/495.07
6,568,555 B1 * 5/2003 LoCascio ..... 220/495.07
2005/0082294 A1 * 4/2005 Ceschi ..... 220/495.07
2007/0215622 A1 * 9/2007 Perez ..... 220/495.07

* cited by examiner

*Primary Examiner* — J. Gregory Pickett
*Assistant Examiner* — Blaine Neway
(74) *Attorney, Agent, or Firm* — Stuart M. Goldstein

(57) ABSTRACT

A trash bag receptacle with trash bag dispenser system has an open top, a bottom floor, and a front wall. The front wall of the container has a slotted opening which extends from the bottom floor upwards along substantially the entire length of the front wall. A channel member with an open top and bottom extends inward into the container, enclosing the slotted opening within the container. A base section supporting the container has an interior space in which a roll of trash bags is rotatably mounted. A single trash bag from the roll is threaded from the interior space and through the channel. The trash bag exits from the open top of the channel where its perforation is separated from the roll of trash bags. The adjacent, next trash bag on the roll remains in the channel member. A new, clean trash bag is thus easily accessible to the user by simply pulling the next trash bag which is exposed through the open top of the channel member.

2 Claims, 4 Drawing Sheets

TRASH RECEPTACLE WITH TRASH BAG DISPENSER SYSTEM

BACKGROUND OF THE INVENTION

Home or office trash receptacles or containers are commonly utilized in combination with disposable trash bags which are inserted into the containers as liners. When the trash bag in a container is filled, it is removed and replaced with a clean, empty bag. However, boxes or rolls of clean bags are usually stored in different locations or even different rooms than the trash container itself. This requires the user to search for and locate the replacement bags and return a single bag to the trash container. In addition, it is common to store extra trash bags in the bottom of the container, under the bag which is being filled with trash. In this case, the user must reach into a usually dirty container and pull out a single bag. This is not only unsanitary, but is also sometimes difficult, since most bags today come in a roll or compact package and they are connected by perforations. As a result, a single bag must be manually ripped from the roller or package and the remaining bags dropped into the container. Storing unused bags in a trash container also has the disadvantage of taking up space in the container, making it necessary to change bags more often.

There have been various attempts to incorporate trash bags within trash containers, with less than stellar results. Prior trash bag container combinations, see, for example in U.S. Pat. Nos. 4,823,979, 5,704,511, 6,193,095, 6,568,555, 7,168,591, 7,395,990, and 7,422,126, have one or more significant disadvantages. Most of these prior trash bag container systems do not have adequate trash bag guide means or any practical means to separate bags located in the container. Many prior art systems are difficult to load, have a multitude of parts, are too complicated to operate efficiently, or just plain do not work. It is not surprising then, that no trash bag container system is currently being successfully sold on the market today.

SUMMARY OF THE INVENTION

It is thus the object of the present invention to provide a trash receptacle with trash bag dispenser system which overcomes the limitations and disadvantages of existing systems.

It is the object of the present invention to provide a trash receptacle with trash bag dispenser system which utilizes a trash receptacle or container which neatly and compactly stores a roll of trash bags, and effectively and efficiently guides the trash bags through and out of the container where the bags are accessible to the user.

It is a further object of the present invention to provide a trash receptacle with trash bag dispenser system which permits the user to quickly and easily remove a single trash bag from a stored roll of bags within the container simply and in a sanitary manner.

It is still another object of the present invention to provide a trash receptacle with trash bag dispenser system which allows for a quick and efficient replacement of a new roll of trash bags within the system.

It is another object of the present invention to provide a trash receptacle with trash bag dispenser system which comprises relatively few parts and so is relatively easy and economical to manufacture.

These and other objects are accomplished by the present invention, a trash receptacle with trash bag dispenser system comprising a trash container having an open top, a bottom floor, and a front wall. The front wall of the container has a slotted opening which extends from the bottom floor upwards along substantially the entire length of the front wall. A channel member with an open top and bottom extends inward into the container, enclosing the slotted opening within the container. A base section supporting the container has an interior space in which a roll of trash bags is rotatably mounted. A single trash bag from the roll is threaded from the interior space and through the channel. The trash bag exits from the open top of the channel where its perforation is separated from the roll of trash bags. The adjacent next trash bag on the roll remains in the channel member. A new, clean trash bag is thus easily accessible to the user by simply pulling this next trash bag on the roll which is exposed through the open top of the channel member.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 4:
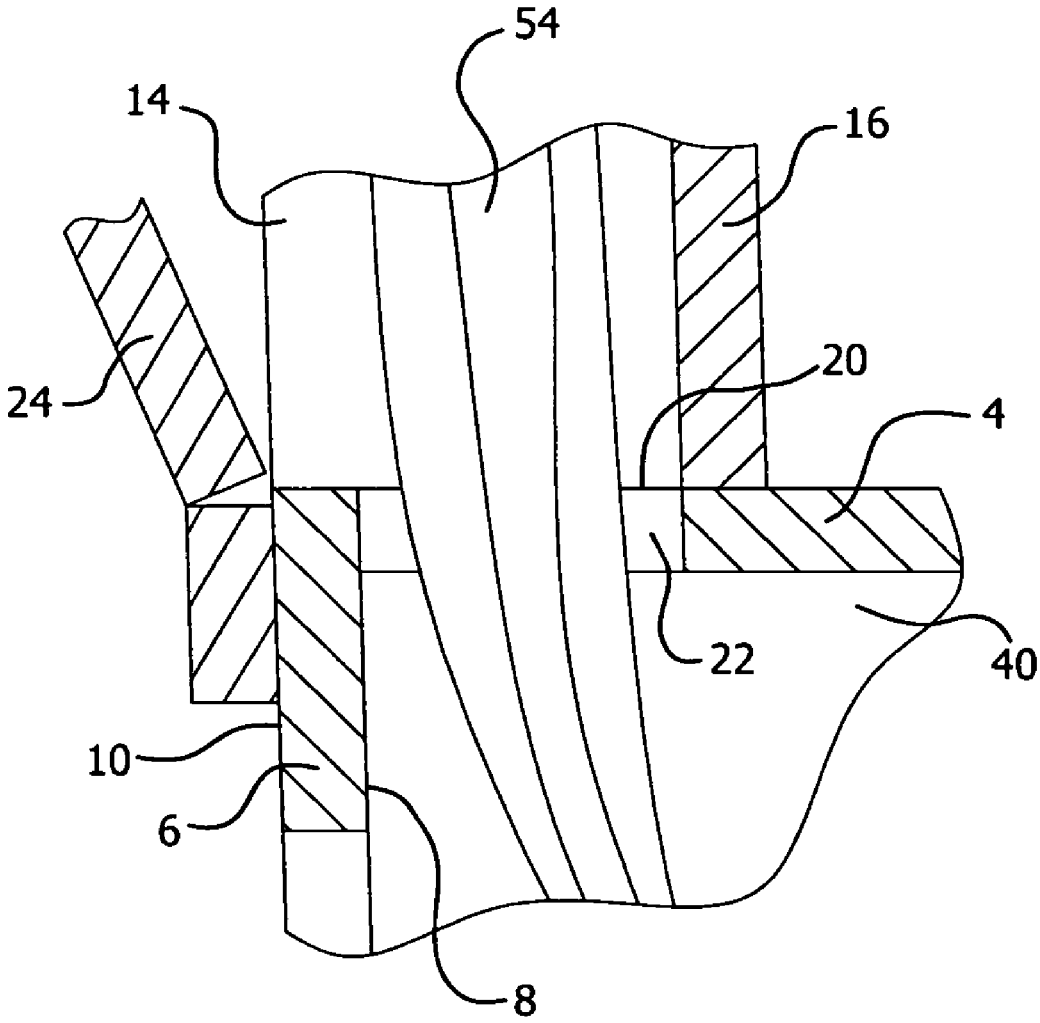
FIG. 4 is a detailed view of the trash bag receptacle with trash bag dispenser system of the present invention, taken from FIG. 3.

The trash receptacle with trash bag dispenser system of the present invention comprises container 2 having bottom floor 4 and front wall 6 with internal surface 8 and external surface 10. See FIG. 4. Container 2 has open top 3 for receiving trash to be collected within interior space 12 of the container. Slotted through opening 14 extends from bottom floor 4 upwards along substantially the entire length of front wall 6 of container 2.

Figure 1:
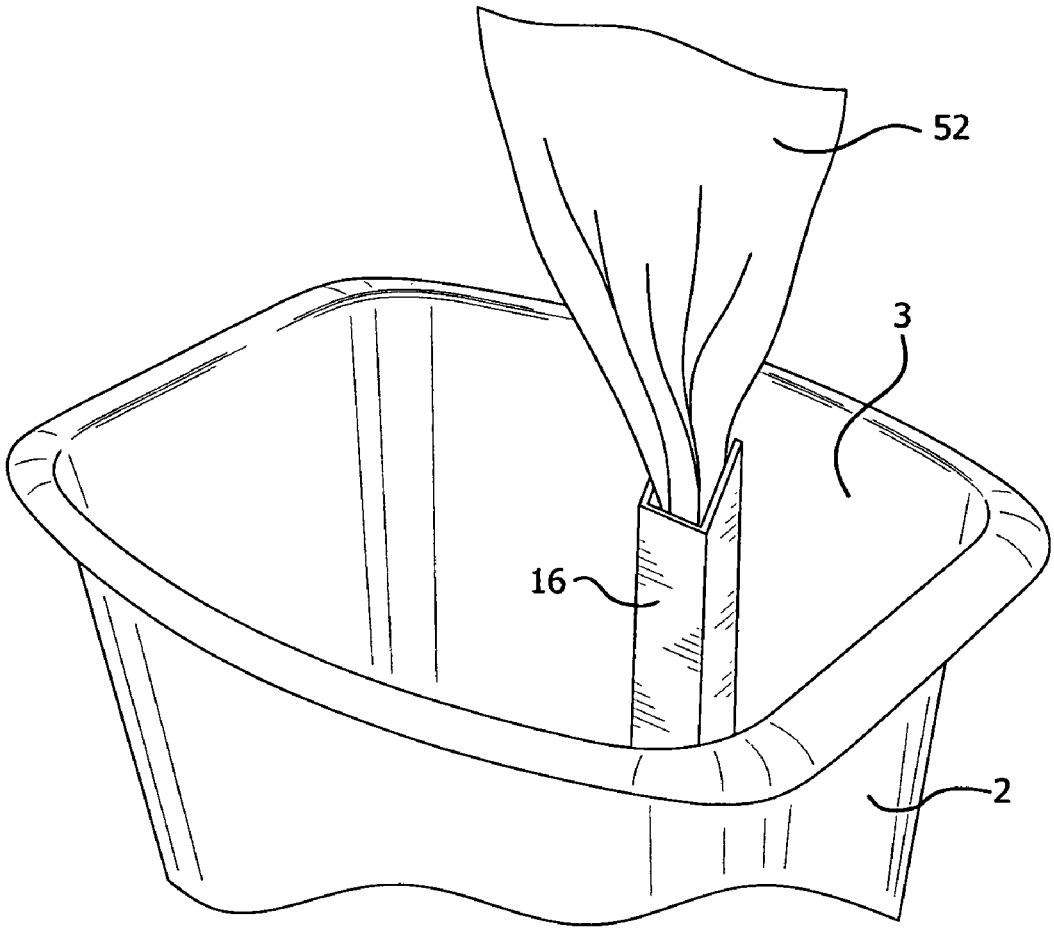
FIG. 1 is a partial top isometric view of the trash bag receptacle with trash bag dispenser system of the present invention.
Figure 2:
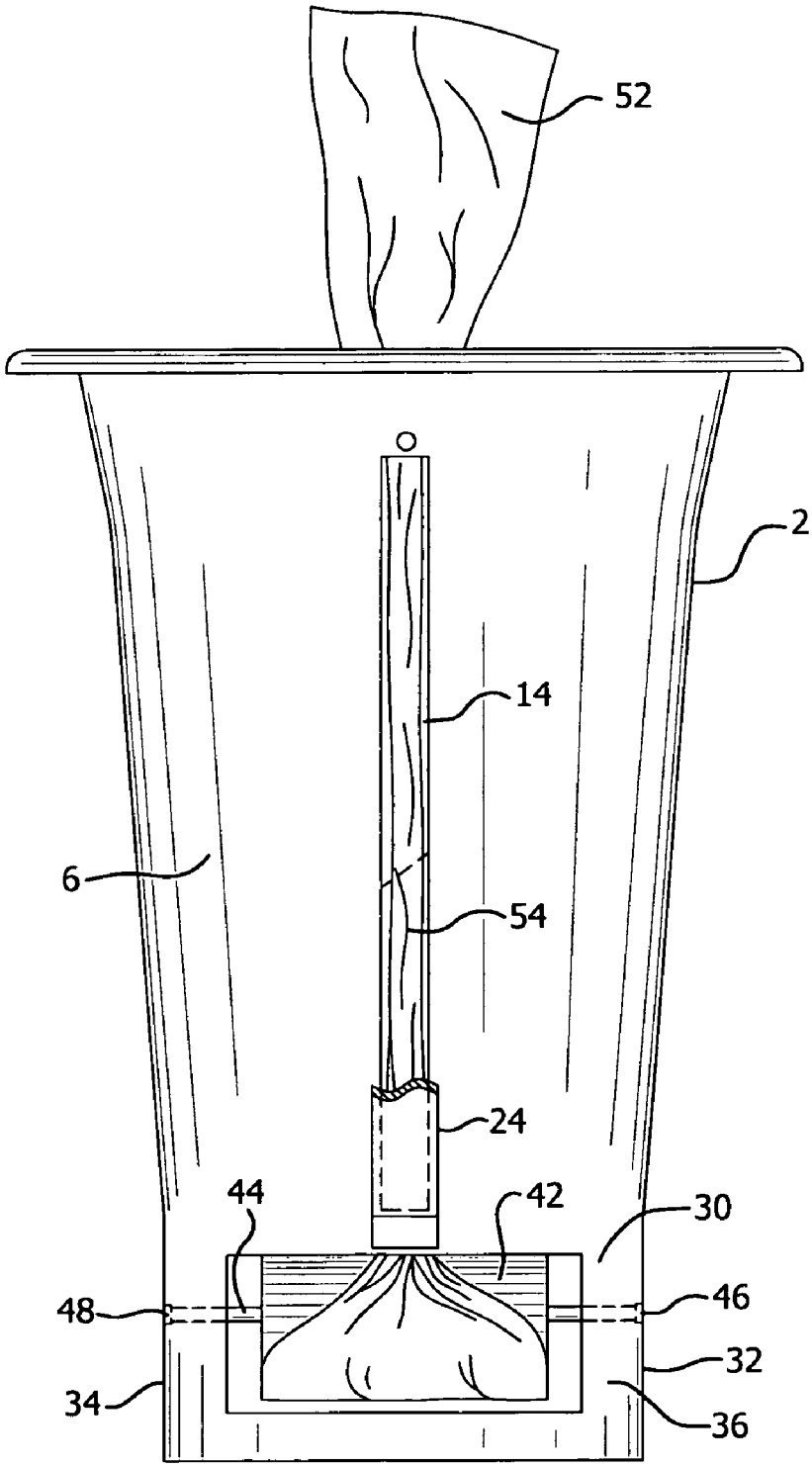
FIG. 2 is an elevation view of the trash bag receptacle with trash bag dispenser system of the present invention with its slotted through opening cover partially in section.
Figure 3:
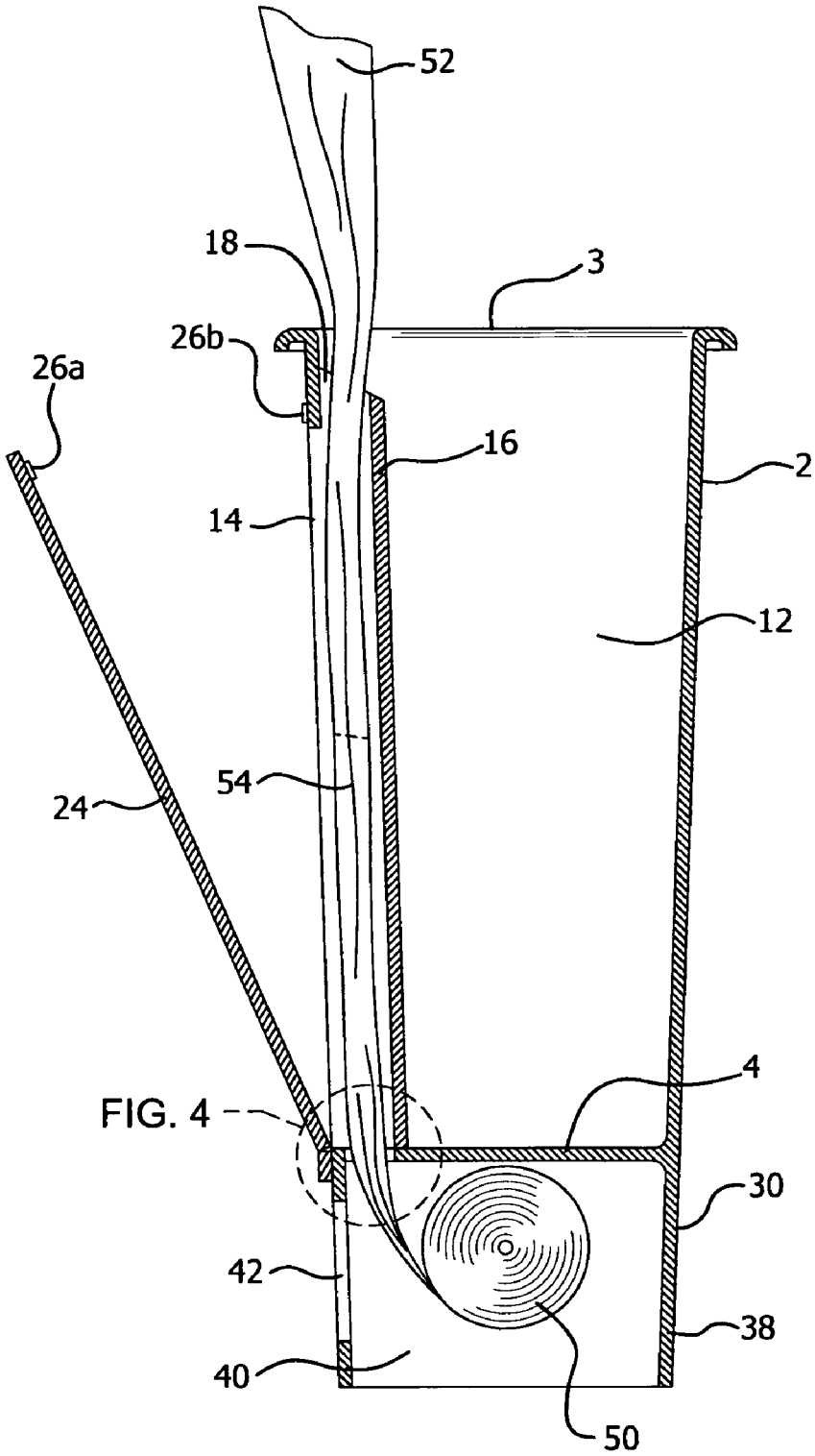
FIG. 3 is a cross-sectional side view of the trash bag receptacle with trash bag dispenser system of the present invention.

Channel member 16, extending inward into interior space 12 of container 2, encloses slotted through opening 14 within the interior space. Channel member 16 has open top 18 and open bottom 20. Top 18 can be partially covered by an optional closure member having an opening with serrated edges. Open bottom 20 is aligned with opening 22 through bottom floor 4. Cover 24, pivotably mounted onto exterior surface 10 of front wall 6, is configured to cover slotted opening 14 and be secured in place by Velcro® 26*a*/26*b* or equivalent attachments. See FIGS. 3 and 4.

Base section 30, located beneath bottom floor 4, supports container 2. Base 30 comprises sidewalls 32 and 34, front wall 36, and rear wall 38, all enclosing internal space 40. Window opening 42, through front wall 36, allows access into internal space 40 of base 30.

Removeable trash bag roll holder rod 44, within internal space 40, extends between sidewalls 32 and 34. Holder rod 44 is rotatably supported by rod tabs 46 and 48 located within sidewalls 32 and 34. Holder rod 44 can be a solid piece or it may be spring loaded. Rod tabs 46 and 48 can either be attached to or molded into sidewalls 32 and 34. Holder rod 44 may be stationary or spin within tabs 46 and 48.

In use, holder rod 44 is removed from internal space 40 of base 30, via access window opening 42. Holder rod 44 is then inserted into the center of roll 50 of trash bags interconnected by perforations, as is commonly known. Rod 44, with roll 50 thereon, is then replaced into interior space 40, rotatably supported by rod tabs 46 and 48. Cover 24 is removed from slotted opening 14 and pivoted downward.

The first bag 52 on the roll 50 of trash bags is pulled through opening 22 through bottom floor 4 and aligned open bottom 20 of channel 16. Bag 52 is then threaded and pulled through channel 16 until it exits out of open top 18 of the channel. All trash bags on roll 50 being interconnected, a second trash bag 54 resides within channel 16 when the first trash bag 52 exits open top 18 of channel 16.

Once the trash bags of roll 50 are fully threaded through channel 16 and the first trash bag 52 exits top opening 18 or the opening in the serrated opening of the optional closure member, the exposed trash bag is then separated from adjacent bag 54 by being ripped off at its perforation or separated by the serrations in the optional closure member. Bag 52 can then be utilized within container 2 as a lining for the container. The user need not bend over or reach into container 2 to retrieve a trash bag.

Once trash bag 52 is full of trash, it is removed from container 2. New trash bag 54 is then easily and conveniently pulled through open top 18 of channel 16, again ripped from its perforations and used to line container 2. As trash bags are removed from channel 16, roll 50 rotates, allowing a continuous flow of trash bags through the channel. When there are no longer trash bags on holder rod 44, the holder rod is again removed and a new roll replaced on the rod and re-threaded through channel 16.

The system of the present invention can be simply and economically manufactured. It is contemplated that container 2 with channel member 16 and base section 30 will be molded as a single unit. The system itself will thus comprise three separate components, the molded container/channel/base member unit, holder rod 44 and cover 24. The system will thereby be lightweight and readily transportable.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A trash receptacle with trash bag dispenser system comprising:

a container for receiving and collecting trash, said container comprising an interior space, a bottom floor, a front wall of given length, said front wall having an internal surface and an external surface, and a slotted through opening extending from the bottom floor along at least over one half the length of the front wall, said through opening extending from the internal surface to the external surface, completely through and along the front wall;

a base located beneath the bottom floor for supporting the container, said base comprising a front wall, sidewalls, and an internal space, the front wall having a window opening providing access to the internal space;

a holder rod rotatably supported by rod tabs located within the sidewalls, said holder rod configured to dispense a roll of interconnected trash bags;

a channel extending over substantially the full length of the through opening, said channel having an open top and an open bottom and rear and lateral walls which extend inwardly into the interior space of the container from the interior surface of the front wall of the container, the open bottom of the channel being aligned with an opening through the bottom floor of the container, the bottom floor leading into the internal space of the base, whereby interconnected trash bags located on the holder rod are configured to be pulled through the open bottom of the channel, through the channel, and out the open top of the channel, wherein a single trash bag is removed from the roll of interconnected trash bags for use within the container, and a cover which is positioned solely over the front wall and overlays the entire length of the through opening, thereby completely covering the through opening, said cover being removeable in order to expose the entire length of the through opening.

2. The trash receptacle with trash bag dispenser system as in claim 1 wherein the channel encloses the slotted through opening.

* * * * *